US006999840B2

(12) United States Patent
Brezina et al.

(10) Patent No.: US 6,999,840 B2
(45) Date of Patent: Feb. 14, 2006

(54) VACUUM PUMP

(75) Inventors: Jürgen Brezina, Köln (DE); Hermann Boy, Kerpen (DE); Christian Beyer, Köln (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 10/494,776

(22) PCT Filed: Oct. 22, 2002

(86) PCT No.: PCT/EP02/11793

§ 371 (c)(1),
(2), (4) Date: May 4, 2004

(87) PCT Pub. No.: WO03/040568

PCT Pub. Date: May 15, 2003

(65) Prior Publication Data

US 2004/0260409 A1 Dec. 23, 2004

(30) Foreign Application Priority Data

Nov. 9, 2001 (DE) ..... 201 18 185 U

(51) Int. Cl.
*G06F 19/00* (2006.01)

(52) U.S. Cl. ..... 700/170; 700/65; 700/66; 700/83; 700/282; 700/287; 700/290; 702/34; 702/181; 702/182; 417/353; 417/418; 417/572

(58) Field of Classification Search ..... 700/65, 700/66, 83, 17, 170, 282, 281, 287, 290; 702/34, 181, 182; 417/353, 418, 572
See application file for complete search history.

(56) References Cited

U.S. PATENT DOCUMENTS

| | | | | |
|---|---|---|---|---|
| 4,639,653 | A * | 1/1987 | Anderson et al. | 318/599 |
| 4,918,585 | A | 4/1990 | Miller et al. | 364/185 |
| 4,985,634 | A * | 1/1991 | Stengl et al. | 250/492.2 |
| 5,392,207 | A * | 2/1995 | Wilson et al. | 700/64 |
| 5,453,926 | A * | 9/1995 | Stroschin et al. | 700/83 |
| 5,579,244 | A * | 11/1996 | Brown | 700/301 |
| 5,621,655 | A * | 4/1997 | Nower et al. | 700/279 |
| 5,805,464 | A * | 9/1998 | Cameron et al. | 700/279 |
| 5,909,372 | A * | 6/1999 | Thybo | 700/83 |
| 6,199,018 | B1 * | 3/2001 | Quist et al. | 702/34 |
| 6,223,102 | B1 * | 4/2001 | Busch | 700/279 |
| 6,242,877 | B1 * | 6/2001 | Irwin et al. | 318/557 |
| 6,445,966 | B1 * | 9/2002 | Younger et al. | 700/83 |

(Continued)

FOREIGN PATENT DOCUMENTS

EP 0 464 571 1/1992

(Continued)

*Primary Examiner*—Ramesh Patel
(74) *Attorney, Agent, or Firm*—Fay, Sharpe, Fagan, Minnich & McKee, LLP

(57) ABSTRACT

A vacuum pump (10) includes a control device (20) for processing operational data and operational instructions. Further, the vacuum pump (10) includes a touch screen (40) serving as display for displaying the operational data callable from the control device (20) and as input for inputting operational instructions into the control device (20). The touch screen (40) includes a display panel (42) and a key panel (44) as display and the input, respectively, and is connected with the control device (20) via a data line (36). By combining the display and the input in a single device, namely the touch screen, the trouble for display and data input is reduced.

9 Claims, 1 Drawing Sheet

U.S. PATENT DOCUMENTS

| | | | | |
|---|---|---|---|---|
| 6,516,656 | B1 * | 2/2003 | Jetter et al. | 73/118.1 |
| 6,588,499 | B1 * | 7/2003 | Fahlsing | 165/231 |
| 2002/0160440 | A1 * | 10/2002 | McDonnell et al. | 435/31 |
| 2004/0111015 | A1 * | 6/2004 | Ladd | 600/300 |

FOREIGN PATENT DOCUMENTS

| | | |
|---|---|---|
| EP | 0 836 008 | 4/1998 |
| JP | 02112681 | 4/1990 |

* cited by examiner

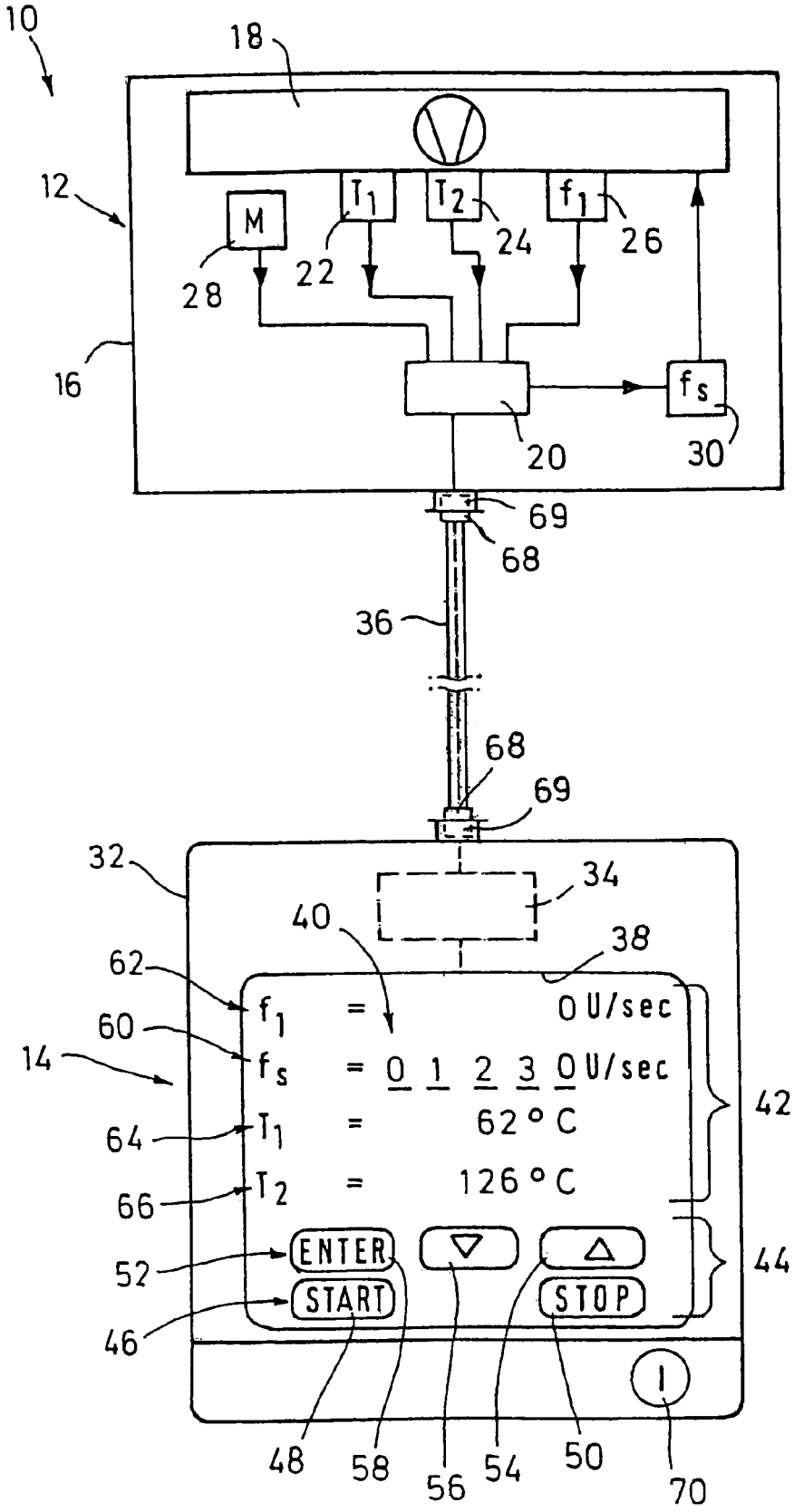
10
18
12
M
T1
T2
f1
22
24
26
28
16
fs
20
30
69
68
36
68
69
32
34
40
38
62
60
14
f1 = 0 U/sec
fs = 0 1 2 3 0 U/sec
T1 = 62 °C
T2 = 126 °C
42
64
66
52
ENTER
START
STOP
44
46
48
58
56
54
50
70

VACUUM PUMP

BACKGROUND OF THE INVENTION

The invention relates to a vacuum pump with a control device for processing operational data and operational instructions.

Known vacuum pumps, turbomolecular pumps, for example, are provided with an electronic control device. By the control device, stored operational instructions are converted into a corresponding control of the drive of the vacuum pump. Further, operational data, for example rotor speeds and operational temperatures, are detected and evaluated in the control device. Via a data line, the control device is connected with a display for displaying the operational data. A separate input means is provided for putting in operational instructions, for example the nominal rotary frequency or a start or stop instruction, and connected with the control device via a data line. Thus, the vacuum pump comprises a display as well as a separate input means as operator interfaces.

It is the object of the invention to reduce the trouble for the operator interfaces in a vacuum pump.

SUMMARY OF THE INVENTION

In the vacuum pump according to the invention, a touch screen is provided that is connected to the control device via a data line and comprises a display panel as display and a key panel as input means. Instead of being provided separately as display and input means, they are combined with each other in a single device, which is the touch screen. A touch screen is a screen comprising a transparent coating on the screen surface through which coating the coordinates of a touch made by a finger or stylus can be detected. Thus, a touch screen permits the mixed and/or alternate use as display panel and key panel. By integrating the display and the input means into a single device, namely the touch screen, a more compact construction is realized and thus, the technical trouble for the operator interfaces is reduced.

Preferably, the vacuum pump comprises a program store containing a program for generating an operational surface on the touch screen. On the touch screen, the program generates the pictorial information required for the representation of the display panel and the key panel. Further, the program contains elements which detect and allocate the actuation of a key of the key panel and call and execute corresponding subroutines. The program memory may be a non-volatile or volatile program memory. The program memory may be a part of the control device, but it may also be configured so as to be completely separate and independent of the control device.

According to a preferred embodiment, a separate operational unit is provided, comprising the touch screen and being connected with the control device via the data line. Such operational units are available at low costs as finished product as so-called "hand-held organizers" and offer a variety of functional possibilities and high memory capacities for recording operational data.

Preferably, the operational unit is mobile and the data line configured so as to be detachable for the transport of the operational unit. By detaching the data line from the control device, the minicomputer with the stored operational data may be made transportable. Thus, operational data from the control device are able to be transferred to another place for being evaluated and there, they can be further evaluated. For the input of operational instructions into the control device and the read-out of operational data from the control device, the operational unit is able to be connected at any time by connecting the data line and establishing the data connection between the control device and the minicomputer.

Preferably, the key panel comprises a start key for starting the pump operation and a stop key for stopping the pump operation. Further, the key panel may comprise input keys for inputting a nominal rotary frequency of a pump rotor.

Preferably, the display panel comprises a temperature indication for indicating an operational temperature that is read out of the control device. Further, the display panel may comprise a rotary frequency indication for indicating the actual rotary frequency of the pump rotor as well as further indications for indicating the pump type, transfer parameters and other information from the control device.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

The FIGURE shows a vacuum pump with a touch screen comprising a display panel and a key panel.

DETAILED DESCRIPTION OF THE PREFERRED EMBODIMENTS

The vacuum pump 10 illustrated in the FIGURE is substantially formed by a pump unit 12 and an operational unit 14. The pump unit 12 is combined in a pump unit housing 16 and comprises a pump aggregate 18 including a pump motor, a control device 20, several sensors 22,24,26 attached to the pump aggregate 18 and connected to the control device 20 via data lines, a non-volatile pump model memory 28 and a nominal rotary frequency memory 30. As sensors, two temperature sensors 22,24 and an actual rotary frequency sensor 26 are provided at and in the pump aggregate 18, respectively. By the actual rotary frequency sensor, the rotary or rotational frequency of the pump rotor of the pump aggregate 18 is detected. The two temperature sensors 22,24 detect the operational temperatures $T_1$, $T_2$ at two spots within the pump aggregate 18. In the pump model memory 28, it is deposited which pump type it is and which characteristic parameters are allocated to the pump aggregate 18.

In the nominal rotary frequency memory 30, a nominal rotary frequency $f_s$ is deposited that is sent to the pump aggregate 18, if necessary. Via data lines, the sensors 22, 24, 26 supply operational data to the control device 20, while an operational instruction able to be sent to the pump aggregate via a data line is stored in the nominal rotary frequency memory 30.

The operational unit 14 is a minicomputer configured as a so-called hand-held organizer. In an operational unit housing 32, the operational unit 14 includes a processor 34 containing control, memory as well as input and output modules. Via a data line 36, the processor 34 is connected with the control device 20 of the pump unit 12. At its two ends, the data line 36 respectively comprises a plug 68 by which it is plugged into a corresponding complimentary socket 69 at the pump unit housing 16 and the operational unit housing 32, respectively. The data line 36 is a serial data line, but it can also be configured as a parallel data line.

At its upper surface, the operational unit 14 comprises a window 38 in which a touch screen 40 is arranged. The touch screen 40 consists of a LCD screen on the visible side of which a transparent sensor layer is deposited the touch of which by a sensor stylus or finger is detected and by which the position of the touch can be detected as coordinates. Thus, the touch screen 40 serves as display for displaying operational data of the pump unit 12 callable from the control device 20 via the data line 36 as well as as input means for inputting operational instructions into the control device 20.

To this end, the touch screen is divided into a display panel 42 and a key panel 44. The key panel 44 in the lower third of the touch screen 40 comprises a start key 48 and a stop key 50 in the lower touch screen line 46. In the touch screen line 52 above, an up key 54, a down key 56 as well as an input key 58 are arranged next to each other.

The keys 48, 50, 54, 56, 58 of the key panel 44 are no mechanically movable keys but they are displayed by the LCD screen. The processor 34 interprets touches in the region of the keys 48, 50, 54, 56, 58 as pressing the displayed key and treats it correspondingly.

At least one memory module of the processor 34 is configured as a program memory containing a program for generating the operational surface on the touch screen 40. By means of this program, the respectively required key panel 44 and display panel 42 is shown on the touch screen 40, and an actuation of one of the keys 48–58 is detected and appropriate further program steps are ordered and executed. The program memory is a non-volatile memory that is configured so as to be rewritable.

By actuating the start key 48, a start signal is output by the processor 34 to the control device 20, whereupon the control device 20 induces the start of the pump aggregate 18. After the stop key 50 has been actuated, a stop signal is output to the control device 20 inducing the pump aggregate 18 to stop the pump activity.

In the second touch screen line of the display panel 42, there is the nominal rotary frequency indication 60 indicating the nominal rotary frequency $f_s$. By actuating the up key 54 and the down key 56, the nominal rotary frequency $f_s$ is able to be adjusted. By actuating an input key 58, the set nominal rotary frequency $f_s$ is finally transferred to the control device 20 that, in turn, writes it into the nominal rotary frequency memory 30.

In the first touch screen line, the actual rotary frequency indication 62 for indicating the actual rotary frequency $f_1$ is located. In the third line, a first operational temperature indication 64 for indicating the first operational temperature $T_1$ is located, and in the fourth line, a second operational temperature indication 66 for indicating a second operational temperature $T_2$ is located.

Alternatively or additionally, it is possible to show further information in the display panel 42, bus and memory addresses, the data transfer speed, voltage and current values of the electric pump motor as well as further technical data of the pump aggregate 18, for example.

Via a mechanical operating switch 70, the operational unit 14 can be switched on and off.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

Having thus described the preferred embodiments, the invention is now claimed to be:

1. A vacuum pump comprising:

a pump unit with a stationary pump aggregate and a plurality of sensors attached to the pump aggregate to generate operational data about the stationary pump aggregate, a control device for processing the operational data and operational instructions, the control device being connected to the sensors to control the pump unit in accordance with the operational data sensed by the sensors and the operational instructions, a display for displaying the operational data callable from the control device, and an input means for inputting the operational instructions into the control device, the display and the input means including:

a touch screen connected with the control device via a data line and comprising a display panel as the display and a key panel as the input means.

2. The vacuum pump according to claim 1, further including:

a program memory which includes a program for generating an operational surface on the touch screen.

3. The vacuum pump according to claim 1, further including:

a separate mobile operational unit which comprises the touch screen which is selectively connected with the control device of a selected stationary pump aggregate via the data line to read out the operational data from and input the operational data to the control device to which it is connected.

4. A vacuum pump comprising:

a pump unit with a stationary pump aggregate and a plurality of sensors attached to the pump aggregate, a control device for processing operational data and operational instructions, the control device being connected to the sensors, a display for displaying the operational data callable from the control device, and an input means for inputting operational instructions into the control device, the display and the input means including:

a touch screen connected with the control device via data lines and comprising a display panel as the display and a key panel as the input means, a separate mobile operational unit which comprises the touch screen which is selectively connectable with and detachable from the control device via the data line, wherein the operational unit is mobile and the data line is configured so as to be detachable for removing the operational unit.

5. The vacuum pump according to claim 4, wherein the key panel comprises a start key for starting the pump operation and a stop key for stopping the pump operation.

6. The vacuum pump according to claim 4, wherein the key panel comprises keys for inputting a nominal rotary frequency.

7. The vacuum pump according to claim 4, wherein the display panel comprises a temperature indication for indicating an operational temperature.

8. The vacuum pump according to claim 4, wherein the display panel comprises a rotary frequency indication for indicating the actual rotary frequency.

9. A vacuum pump system comprising:

(a) at least one stationary vacuum pump unit, each vacuum pump unit including:

a control device, sensors for sensing actual pump parameters, the sensors being connected with the control device, an interface means connected with the control device;

(b) a mobile operational unit including:

a touch screen having a display panel for displaying pump parameters, the display panel defining touch keys through which an operator inputs information, a means for temporarily interconnecting the touch screen with the interface means to (1) display actual pump parameters sensed by the sensors and (2) communicate operating instructions input through the touch keys to the control device.

* * * * *